US006380453B1

(12) United States Patent
Hutson et al.

(10) Patent No.: US 6,380,453 B1
(45) Date of Patent: Apr. 30, 2002

(54) NUCLEAR REPROCESSING SOLVENT TREATMENT

(75) Inventors: Graham Victor Hutson; Chris Eaves, both of Seascale (GB)

(73) Assignee: British Nuclear Fuels PLC (GB)

( * ) Notice: Subject to any disclaimer, the term of this patent is extended or adjusted under 35 U.S.C. 154(b) by 0 days.

(21) Appl. No.: 09/308,722

(22) PCT Filed: Nov. 18, 1997

(86) PCT No.: PCT/GB97/03156

§ 371 Date: Sep. 27, 1999

§ 102(e) Date: Sep. 27, 1999

(87) PCT Pub. No.: WO98/22954

PCT Pub. Date: May 28, 1998

(30) Foreign Application Priority Data

Nov. 19, 1996 (GB) ..... 9624006

(51) Int. Cl.[7] ..... G21F 9/00
(52) U.S. Cl. ..... 588/18; 588/20
(58) Field of Search ..... 588/3, 10, 11, 588/18, 20; 976/DIG. 379; 210/759, 761, 908; 203/29

(56) References Cited

U.S. PATENT DOCUMENTS 5,114,623 A * 5/1992 Hutson ..... 252/631
5,523,515 A * 6/1996 Nemoto et al. ..... 588/20
5,707,922 A * 1/1998 Mimori et al. ..... 502/416

FOREIGN PATENT DOCUMENTS

EP 0 342 876 A3 11/1989 ..... G21F/9/06
EP 0 428 309 A2 5/1991 ..... A62D/3/00

OTHER PUBLICATIONS

Ginisty et al.; Solvent distillation studies for a purex reprocessing plant, Sixth Symposium on Separation Science and Technology for Energy Applications 25:13–15 1941–1952 (1990).
Guillaume et al.; Solvent management in a reprocessing plant, International Conference on Nuclear Fuel Reprocessing and Waste Management, Paris, France 23–28 Aug. 1987 (p. 1–8).
Motoi et al.; Solvent purification by distillation and minimizing wastes in a reprocessing plant, International Conference on Nuclear Fuel Re, France 1987 (p. 417–421).
Pradel; The organic waste treatment in UP3–La Hague, Proceedings of the 3rd Int'l Conf. on Nuclear Fuel Reprocessing and Waste Management, 1991 (p. 1101–1106).
International Search Report, PCT/GB97/03156.

* cited by examiner

*Primary Examiner*—Stuart L. Hendrickson
*Assistant Examiner*—Eileen E. Nave
(74) *Attorney, Agent, or Firm*—Myers Bigel Sibley & Sajovec P.A.

(57) ABSTRACT

A process is disclosed for the treatment of a solvent which has been used in nuclear fuel reprocessing or uranium ore purification, the solvent comprising an organophosphate ester and a hydrocarbon diluent. The process includes distilling the solvent under reduced pressure to remove substantially all the diluent and a major proportion of the organic ester, converting organophosphate to inorganic phosphate and encapsulating the residual material.

7 Claims, 1 Drawing Sheet

NUCLEAR REPROCESSING SOLVENT TREATMENT

INTRODUCTION

This invention is concerned with waste treatment and in particular the treatment of solvents used in nuclear fuel reprocessing and uranium ore purification. More particularly, the invention is concerned with the treatment of a solvent comprising an organophosphate ester and a hydrocarbon diluent A typical such solvent is tributyl phosphate and diluents are odourless kerosene (OK), dodecane or a hydrogenated propylene tetramer (HPT). The phosphate ester is typically present in an amount of between 5 and 35% by volume.

PRIOR ART

EP 342876 discloses a process for the treatment of such a solvent in which the alkyl phosphate is reacted with hydrogen peroxide in aqueous solution added progressively at a temperature that is above ambient temperature and in the presence of a transition metal catalyst which is a chromium compound. The aqueous hydrogen peroxide phase is maintained at a pH which is mildly acidic, neutral or mildly alkaline by the controlled introduction of alkali at a rate that is sufficient to neutralise the acid released by decomposition of the alkyl phosphate, thereby significantly accelerating the rate of decomposition of the alkyl phosphate.

EP 428309 discloses a process Li which the alkyl phosphate is reacted with an aqueous solution of an alkaline metal hydroxide at elevated temperature and a part of the reaction product is then reacted with an aqueous solution of hydrogen peroxide in the presence of an effective amount of a transition metal catalyst.

Ginisty, C. et al (Solvent distillation studies for a purex reprocessing plant." Sixth Symposium on Separation Science and Technology for Energy Applications. Volume 25, Numbers 13–15. Editor Bell, J. T. ; Watson J. S. Oak Ridge National Lab., TN (USA) 1990. P. 1941–1952 discloses a solvent distilation system for regeneration of purex solvent. The organic residues are subjected directly to a pyrolysis treatment which is not desirable having regard to the safety requirements involved with the disposal of radioactive materials.

EP 0 342 876 A is concerned with the treatment of alkylphosphate and particularly alkylphosphate located in an organic solvent. A process involving hydrolysis and oxidation is proposed.

Motoi, V. et al ("Solvent purification by distillation and minimising wastes in a reprocessing plant. Purification du solvant par rectification et minimalisation des dechets pour une usine de retraitement." Record 87. Nuclear Fuel Reprocessing and Waste Management Vol. 1. Societe Francaise D'energie Nucleaire. 1987. P. 417–421 OF 492 P. Conference: International Conference on Nuclear Fuel Re. France, XP00060207) discloses a process involving the recover of TBP and diluent and suggests that residual organic materials may be subjected to pyrolysis or encapsulation in cement.

STATEMENT OF INVENTION

According to the present invention there is provided a process for the treatment of a solvent which has been used in nuclear fuel reprocessing or uranium ore purification and which comprises an organophosphate ester and a hydrocarbon diluent, the process comprising distilling the solvent under reduced pressure to remove substantially all the diluent and a major proportion of the organophosphate ester, converting organophosphate to inorganic phosphate and encapsulating the residual material.

The term encapsulation is used to include vitrification or alternative encapsulation methods such as location within cement.

BRIEF DESCRIPTION OF THE DRAWING

The FIGURE is a flow chart showing processes for the treatment of a solvent comprising tributyl phosphate and odourless kerosene in which the amount of tributyl phosphate is about 30% volume.

DETAILED DESCRIPTION

Figure 1:
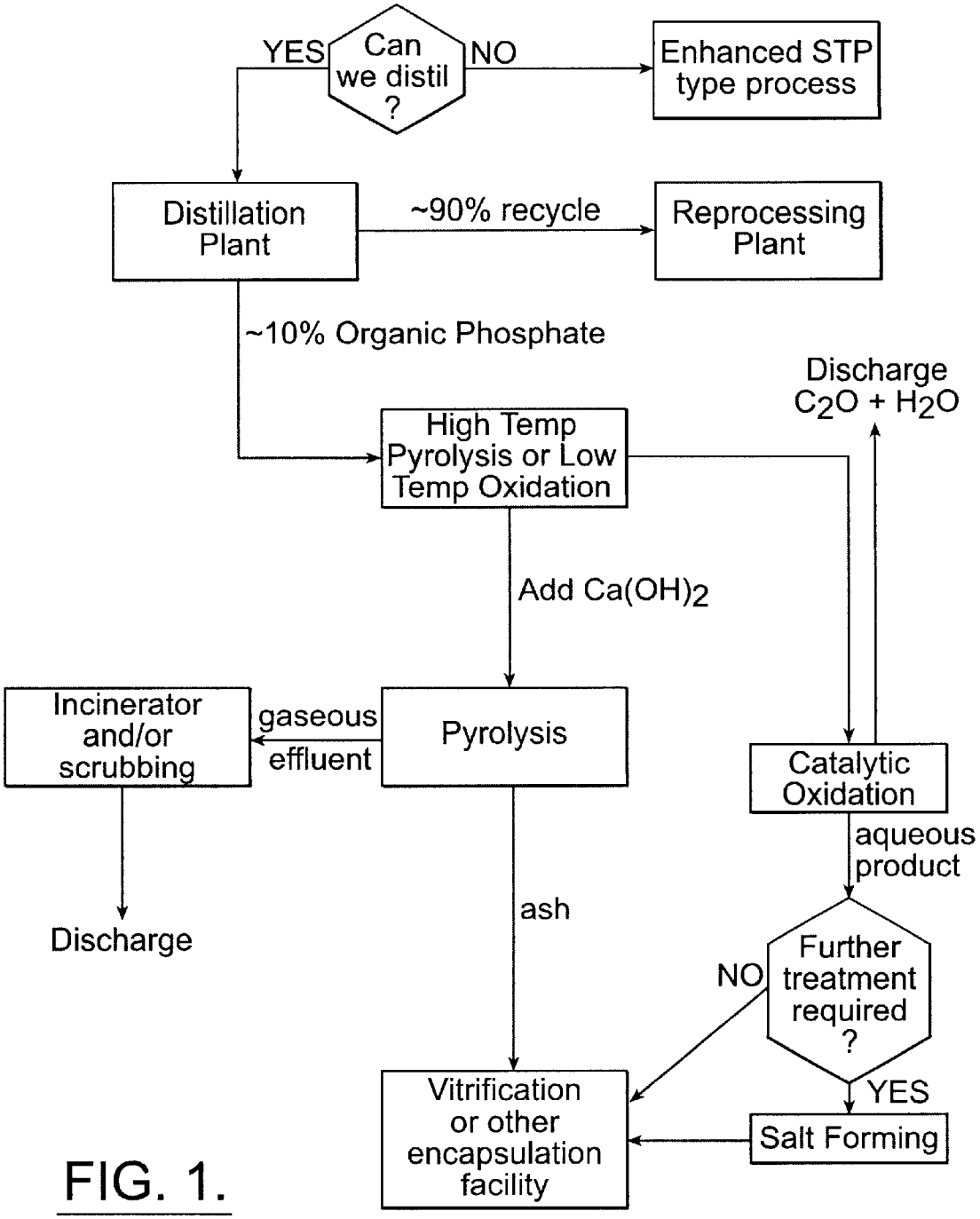

An embodiment of a process in accordance with the present invention will now be described with reference to the accompanying drawing which is a flow chart showing processes for the treatment of a solvent comprising tributyl phosphate and adourless kerosene in which the amount of tributyl phosphate is about 30% by volume.

The first stage in the process is the distillation, under reduced pressure, of solvent which has become too degraded for further use. The distillation is carried out to remove substantially al the diluent and a major proportion of the phosphate ester, for example, 90% of the total volume of organic material. This distillate is returned to the reprocessing or ore purification process.

The residual volume consists essentially of organophosphate plus some phosphatic and diluent degradation products. This material is treated to convert the organophosphate to inorganic phosphate salts, such as a calcium salt. Preferred processes are high temperature processes or chemical oxidation processes.

A high temperature process may be carried out by mixing the residue solvent with a metal salt hydroxide in aqueous solution or suspension for instance, calcium hydroxide, and then feeding the mixture to a stirred pebble ball reactor at about 550° C., thereby producing a metal phosphate ash. This ash may be fed to a vitrification plant and the organics volatilised from the reactor and combusted.

An alternative process is chemical oxidation, typically using a metallic catalyst such as sodium dichromate and hydrogen peroxide at a temperature of between ambient and boiling point (around 100° C.) in an aqueous medium. This reaction produces an aqueous phosphoric acid, which is then reacted with an aqueous solution or suspension of a metal hydroxide such as calcium hydroxide. A metal phosphate salt solution is produced which is fed to vitrification or an alternative encapsulation method, such as encapsulation in cement. Prior to encapsulation, the material may be mixed with other radioactive waste.

A process in accordance with the present invention is applicable to the treatment of a variety of solvents comprising an organophosphate ester and a hydrocarbon diluent. Mention has been made above to a number of hydrocarbon diluents. Two further examples of such diluents are Exxsol D80 and Isopar L. Exxsol D80 is a kerosene type material which can be used as a direct replacement for OK in reprocessing plants and has a narrower boiling point (202°–240° C.) than OK (180°–280° C.). Isopar L is a highly branched chain material with a very narrow boiling point range (190°–210° C.).

What is claimed is:

1. A process for the treatment of a solvent which has been used in nuclear fuel reprocessing or uranium ore purification and which comprises an organophosphate ester and a hydrocarbon diluent, the process comprising distilling the solvent under reduced pressure to remove substantially all the diluent and a major proportion of the organophosphate ester and wherein a residual material including organophosphate is also formed, converting organophosphate present in the residual material to inorganic phosphate and encapsulating the inorganic phosphate.

2. A process according to claim 1 in which the distillate, containing substantially all of the diluent and a major proportion of the organophosphate ester, is returned to the reprocessing or purification process.

3. A process according to claim 1 in which said encapsulating step is vitrification.

4. A process according to claim 1 in which the organophosphate is converted to inorganic phosphate by a temperature process or a chemical oxidation process, wherein the temperature process comprises mixing the residual material with a metal salt hydroxide in aqueous solution to form a mixture and then treating the mixture to produce a metal phosphate ash.

5. A process according to claim 4 in which the chemical oxidation process includes using a metallic catalyst and hydrogen peroxide.

6. A process according to claim 5 in which the chemical oxidation process is carried out at a temperature between ambient and boiling point in an aqueous medium.

7. A process according to claim 1 in which the hydrocarbon diluent is odourless kerosene or a dodecane.

* * * * *

UNITED STATES PATENT AND TRADEMARK OFFICE

CERTIFICATE OF CORRECTION

PATENT NO. : 6,380,453 B1
DATED : April 30, 2002
INVENTOR(S) : Hutson et al.

It is certified that error appears in the above-identified patent and that said Letters Patent is hereby corrected as shown below:

Column 1,
Line 29, should read -- EP 428309 discloses a process in which the alkyl phos --
Line 57, should read -- XP00060207) discloses a process involving the recovery of --

Column 2,
Line 20, should read -- phosphate and odourless kerosene in which the amount of --

Column 3,
Line 14, should read -- sulating process is vitrification. --

Signed and Sealed this

Seventeenth Day of December, 2002

JAMES E. ROGAN
*Director of the United States Patent and Trademark Office*